US006736116B2

(12) United States Patent
Kawano

(10) Patent No.: US 6,736,116 B2
(45) Date of Patent: May 18, 2004

(54) FUEL VAPOR TREATMENT SYSTEM

(75) Inventor: Akihiro Kawano, Atsugi (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/163,308

(22) Filed: Jun. 7, 2002

(65) Prior Publication Data

US 2003/0029226 A1 Feb. 13, 2003

(30) Foreign Application Priority Data

Jul. 30, 2001 (JP) ..... 2001-228957

(51) Int. Cl.[7] ..... F02M 33/04
(52) U.S. Cl. ..... 123/520; 73/118.1
(58) Field of Search ..... 123/519, 520, 123/518; 73/118.1

(56) References Cited

U.S. PATENT DOCUMENTS 5,460,142 A * 10/1995 Denz et al. ..... 123/520
5,767,395 A 6/1998 Goto et al.
5,845,625 A 12/1998 Kidokoro et al.
6,227,037 B1 5/2001 Kawamura et al.
6,276,343 B1 * 8/2001 Kawamura et al. ..... 123/520
6,330,879 B1 * 12/2001 Kitamura et al. ..... 123/520

FOREIGN PATENT DOCUMENTS

JP 7-317611 A 12/1995
JP 2001-107776 A 4/2001

* cited by examiner

*Primary Examiner*—Thomas N. Moulis
(74) *Attorney, Agent, or Firm*—Shinjyu Global IP; Counselors, LLP

(57) ABSTRACT

A fuel vapor treatment system is provided that diagnoses failure of the drain cut valve using one absolute pressure sensor. The fuel vapor treatment system includes a fuel tank, a canister, a drain cut valve, a purge valve, purge piping and a sensor. The canister adsorbs fuel vapor evaporated from the fuel tank. The drain cut valve controls the introduction of air into the canister. The purge valve is disposed between the canister and an intake passage into which fuel vapor flows from the canister. The purge piping communicates between the fuel tank and the intake passage via the canister. The sensor detects the absolute pressure inside the purge piping. The fuel vapor treatment system is further equipped with a failure diagnosis device that sets a reference pressure used for failure diagnosis of the drain cut valve while the purge valve is closed.

18 Claims, 12 Drawing Sheets

The atmospheric pressure increases and the difference between the atmospheric pressure and the negative pressure applied to the system reaches or exceeds the pressure that makes the release valve in the filler cap to open. The opened release valve changes the system pressure. As a result, a Determination of NG is issued even if there is not a leak.

FUEL VAPOR TREATMENT SYSTEM

BACKGROUND OF THE INVENTION

1. Field of the Invention

The present invention generally relates to a fuel vapor treatment system. More specifically, the present invention relates a fuel vapor treatment system equipped with a failure diagnosis device.

2. Background Information

An example of a fuel vapor treatment system is described in Japanese Laid-Open Patent Publication No. 07-317611. This fuel vapor treatment system has an absolute pressure sensor installed in the evaporation passage that communicates between the fuel tank and the canister. By measuring the atmospheric pressure as a reference pressure, this fuel vapor treatment system diagnoses leaks inside the fuel vapor treatment system based on the difference between the reference pressure and the pressure inside the evaporation passage.

In view of the above, there exists a need for an improved fuel vapor treatment system. This invention addresses this need in the art as well as other needs, which will become apparent to those skilled in the art from this disclosure.

SUMMARY OF THE INVENTION

The fuel vapor treatment system just described requires the installation of two sensors, i.e., an absolute pressure sensor and an atmospheric pressure sensor, and thus invites higher cost.

If the atmospheric pressure sensor is eliminated, the pressure inside the fuel vapor treatment system will fluctuate when the engine is started because of negative pressure inside the intake manifold. This creates a problem in that, during the fluctuation, it cannot be determined if the pressure value detected by the absolute pressure sensor is normal or if it is the pressure obtained when the drain cut valve provided on the canister is stuck in the closed state.

Furthermore, if one attempts to measure the reference pressure after the engine is started and the drain cut valve happens to fail such that it is stuck in the closed state, negative pressure inside the intake manifold will cause negative pressure inside the purge pipe and it will not be possible to set the reference pressure.

Therefore, the object of the present invention is to provide a fuel vapor treatment system that diagnoses failure of the drain cut valve and solves the aforementioned problems.

In accordance with the present invention, a fuel vapor treatment system is provided that basically comprises a fuel tank, a canister, a purge valve, a sensor and a failure diagnosis device. The canister is fluidly coupled to the fuel tank by a first pipe and configured to adsorb fuel vapor evaporated from the fuel tank. The drain cut valve is operatively coupled to the canister to control air flow into the canister. The purge valve is disposed in a second pipe fluidly coupled between the canister and an intake passage of an internal combustion engine into which fuel vapor flows from the canister. The sensor is configured and arranged to detect absolute pressure inside at least one of the first and second pipes. The failure diagnosis device is configured and arranged to set a reference pressure used for failure diagnosis of the drain cut valve while the purge valve is closed.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
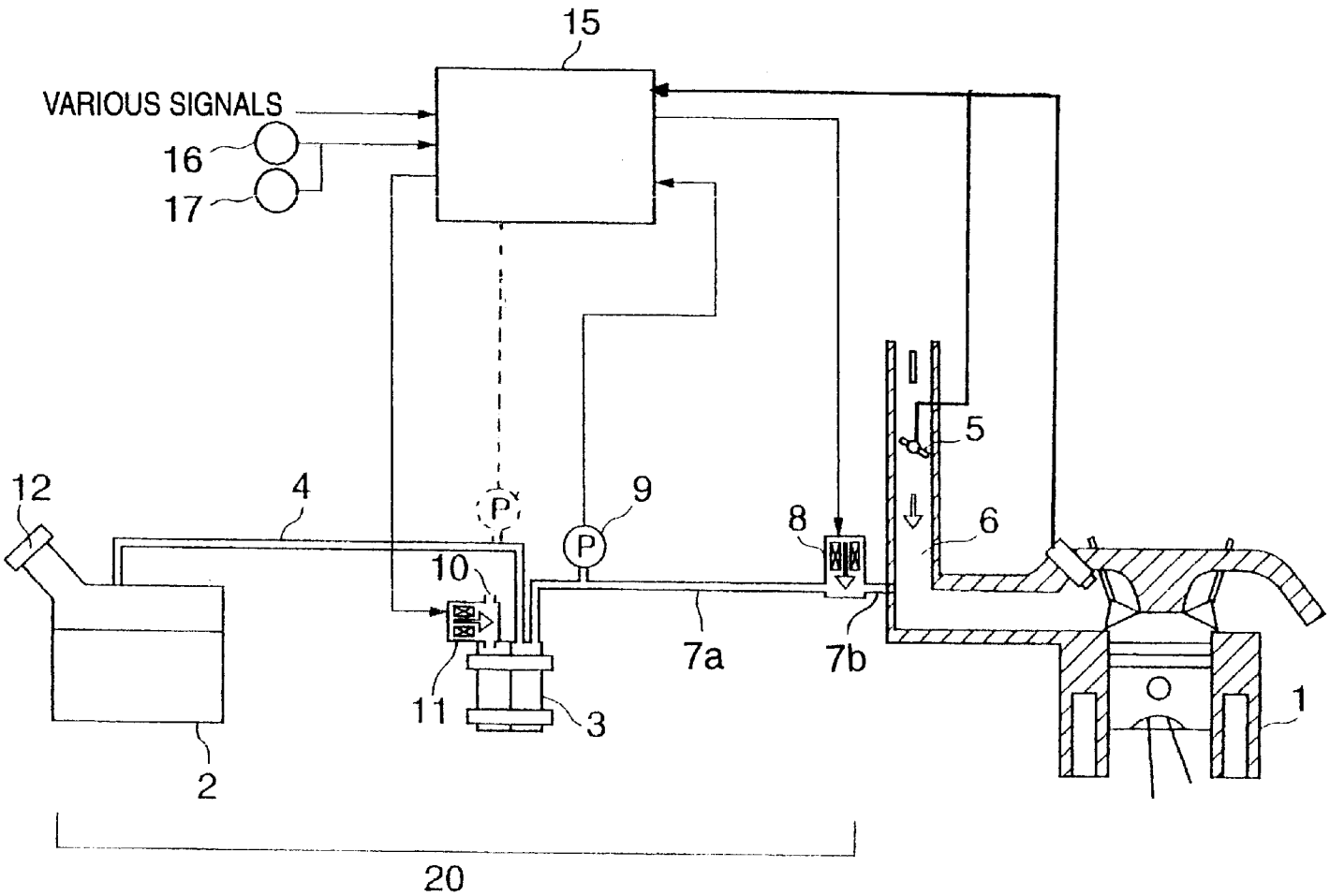
FIG. 1 is a schematic view of a fuel vapor treatment system in accordance with one embodiment of the present invention.

Referring initially to FIG. 1, a schematic view of a fuel vapor treatment system 20 is illustrated in accordance with a first embodiment of the present invention. The fuel vapor treatment system 20 serves to treat fuel vapor that is generated inside a fuel tank 2 of an engine 1 that is equipped with a canister 3 containing a fuel adsorbing material (e.g., activated carbon). The fuel tank 2 and the canister 3 are fluidly coupled together by a first purge pipe 4. The canister 3 is also fluidly coupled to an intake passage 6 by a pair of purge pipes 7*a* and 7*b* at location that is downstream of a throttle valve 5 of the engine 1. The purge pipes 4, 7*a* and 7*b* together form a purge piping that interconnects the fuel tank 2 to the intake passage 6 via the canister 3. The purge pipe 4 forms a first purge pipe extending between the fuel tank 2 and the canister 3, while the purge pipes 7*a* and 7*b* form a second purge pipe extending between the canister 3 and the intake passage 6.

A purge valve 8 is provided between the purge pipes 7*a* and 7*b* for opening and closing the connection between the purge pipes 7*a* and 7*b*. An absolute pressure sensor 9 measures both the pressure (absolute pressure) inside the purge piping and the atmospheric pressure (absolute pressure), in a manner described later. The absolute pressure sensor 9 is located between the fuel tank 2 and the purge valve 8. Thus, it is also acceptable to install the absolute pressure sensor 9 anywhere in the first purge pipe 4 such as shown in broken lines in FIG. 1.

The canister 3 is provided with an atmospheric release port 10. Preferably, the atmospheric release port 10 is part of a drain cut valve 11, which opens and closes the atmospheric release port 10.

Fuel vapor generated inside the fuel tank 2 is directed to the canister 3 through the first purge pipe 4. The fuel component of the vapor is adsorbed by the activated carbon inside the canister 3, while the remaining air is discharged to the outside through the atmospheric release port 10. Then, in order to treat the fuel adsorbed by the activated carbon, the purge valve 8 opens and fresh air is introduced into the canister 3 through the atmospheric release port 10 by utilizing the negative intake pressure downstream of the throttle valve 5. This fresh air causes the adsorbed fuel to separate from the activated carbon and be removed together with the fresh air into the intake passage 6 of the engine 1 through the purge pipes 7*a* and 7*b*.

The pressure value detected by the absolute pressure sensor 9 is sent to a controller 15 that functions as both an atmospheric pressure setting device and a failure diagnosis device. The controller 15 preferably includes a microcomputer with a control program that controls the operation of the engine 1 and the fuel vapor treatment system 20 as discussed below. The controller 15 can also include other conventional components such as an input interface circuit, an output interface circuit, and storage devices such as a ROM (Read Only Memory) device and a RAM (Random Access Memory) device. The memory circuit stores processing results and control programs that are run by the processor circuit. The controller 15 is operatively coupled to the various sensors in a conventional manner. The internal RAM of the controller 15 stores statuses of operational flags and various control data. The internal ROM of the controller 15 stores the signals from the various sensors and the operational states of the purge valve 8 and the drain cut valve 11 for various operations. The controller 15 is capable of selectively controlling any of the components of the control system in accordance with the control program. It will be apparent to those skilled in the art from this disclosure that the precise structure and algorithms for the controller 15 can be any combination of hardware and software that will carry out the functions of the present invention. In other words, "means plus function" clauses as utilized in the specification and claims should include any structure or hardware and/or algorithm or software that can be utilized to carry out the function of the "means plus function" clause.

The controller 15 receives at least informational signals from a vehicle speed sensor 16, a fuel temperature sensor 17, and various other sensors (not shown) that detect the operating conditions of the engine. Based on the engine speed, intake air flow rate, throttle opening, coolant temperature, intake air temperature, vehicle speed, fuel temperature, fuel injection quantity, etc., the controller 15 opens and closes the purge valve 8 in specified operating regions (e.g., steady-state travel) and executes purge control (steady-state purge treatment) by controlling the opening and closing of the purge valve 8.

Meanwhile, based on the engine speed, intake air flow rate, throttle opening, coolant temperature, intake air temperature, vehicle speed, fuel temperature, fuel injection quantity, atmospheric pressure (according to the absolute pressure sensor 9), etc., the controller 15 determines the permission conditions necessary for executing a leak diagnosis of the fuel vapor treatment system 20 extending between the fuel tank 2 and the purge valve 8. If the permission conditions are satisfied, then the controller 15 executes the leak diagnosis.

The controller 15 also receives at least the following signals: an output signal indicating the boost pressure inside the intake passage 6, an ON-OFF signal from an ignition switch, an ON-OFF signal from a starter switch that starts a starter motor, a battery voltage signal, and an engine speed signal. Based on at least these input values, the controller 15 opens and closes the purge valve 8 and the drain cut valve 11 in response to the operating conditions of the engine 1 and controls the purging of the adsorbed fuel vapor from the canister 3. Also based on these input values, the controller 15 executes the failure diagnosis of the drain cut valve 11. Also based on at least some of these input valves, the controller 15 is configured to control the throttle valve 5 and the fuel injector as seen in FIG. 1 as well as other engine components such as the intake valves, the exhaust valves, and the fuel igniter.

Figure 2:
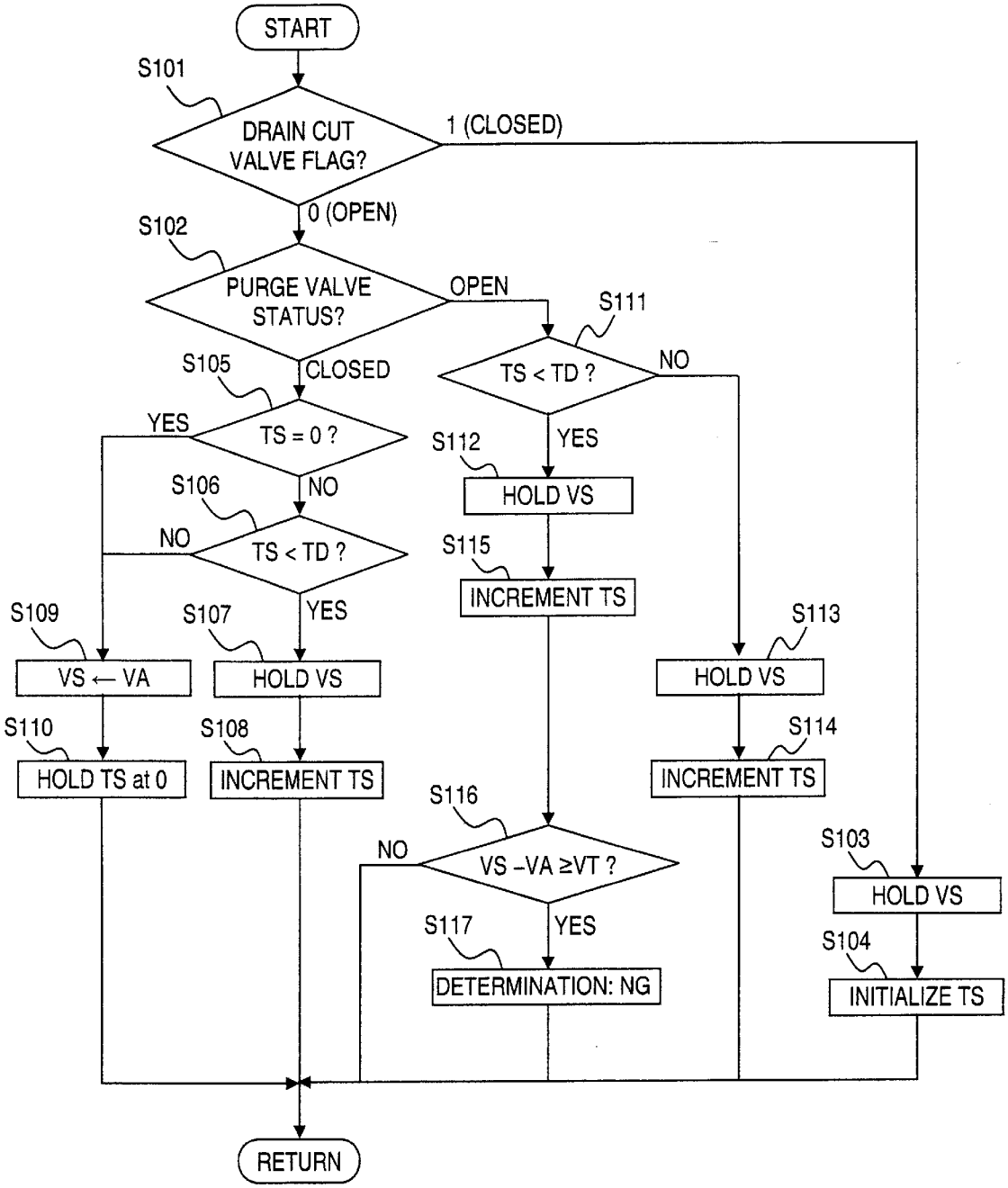
FIG. 2 is a control flowchart for determining a failure of a purge valve in the fuel vapor treatment system illustrated FIG. 1 in accordance with the present invention.

As seen in the flow chart of FIG. 2, the reference pressure used for failure diagnosis of the drain cut valve 11 can be set reliably and accurately without using an atmospheric pressure sensor because the reference pressure is set while the purge valve 8 is closed, i.e., it is set based on the absolute pressure inside the purge pipe 7*a* detected by the sensor 9 immediately before purging to the intake passage 6 commences.

The failure diagnosis device calculates the pressure difference between the reference pressure and the absolute pressure inside the purge pipe 7*a* after purging commences and determines if the drain cut valve 11 has failed based on the pressure difference. Thus, failure of the drain cut valve 11 can be diagnosed with only one absolute pressure sensor 9 installed in the purge path.

The pressure difference is calculated within a prescribed period of time after the reference pressure is set. Therefore, the present invention can prevent incorrect failure diagnosis caused by changes in the reference pressure when the atmospheric pressure fluctuates due to movement of the vehicle.

The frequency with which failure diagnosis is conducted can be increased because the reference pressure is successively overwritten when purging to the intake passage is stopped and the drain cut valve 11 has been open for a prescribed period of time or longer.

The accuracy of the failure diagnosis is improved because the reference pressure is maintained when purging to the intake passage 6 is stopped and the drain cut valve 11 has been open for less than a prescribed period of time.

Next, the failure diagnosis that the controller 15 conducts on the drain cut valve 11 will be explained using the flowchart shown in FIG. 2. The control cycles executed by the controller 15 are preferably conducted at fixed intervals, e.g., every 10 milliseconds.

In Step S101, the controller 15 determines if the drain cut valve 11 is open or closed. The drain cut valve 11 is determined to be closed when the value of the flag is 1 and open when the value of the flag is 0. Initially the flag is set to 0. Control proceeds to Step S102 if the drain cut valve 11 is open and Step S103 if the drain cut valve 11 is closed.

In Step S103, the failure diagnosis is cancelled because the drain cut valve 11 is closed and, consequently, the voltage VS of the absolute pressure sensor 8, which serves as the reference pressure (atmospheric pressure), is maintained. Next, in Step S104, the elapsed time TS on the timer that counts the time elapsed after the reference pressure was set is initialized and this control cycle ends. The initial value of the voltage VS of the absolute pressure sensor 9 that corresponds to the reference pressure is previously stored in memory of the controller 15.

In Step S102, the controller 15 determines if the purge operation is being executed by determining if the purge valve 8 is open or closed. If the purge valve 8 is closed (i.e., in a purge cut state where fuel vapor is not being introduced from the canister 3 to the intake passage 6), then control proceeds to Step S105 where the controller 15 determines if the elapsed time TS since setting the reference pressure is 0 (zero). If the elapsed time is not 0, i.e., if some time has elapsed since the reference pressure was set, then control proceeds to Step S106 where the controller 15 determines if the elapsed time TS of the timer is shorter than a prescribed time period TD (150 seconds). If the elapsed time is shorter, the voltage VS of the absolute pressure sensor 9 is maintained (Step S107), the elapsed time TS since setting the reference pressure is incremented (Step S108), and then control ends. Thus, the reference pressure is held when the purge cut state has existed for a time period shorter than time period TD. The amount of time the reference pressure is held is determined based on vehicle speed and slope of the road, e.g., 150 seconds when the vehicle speed is 150 km/h or higher. Maintaining the voltage VS of the absolute pressure sensor 9 in Step S107 when elapsed time TS is shorter than prescribed time period TD increases the frequency of the failure diagnosis and increases the precision of the failure diagnosis.

If the elapsed time TS since the reference pressure was set is 0 in Step S105, then control proceeds to Step S109 and the latest voltage VA detected by the absolute pressure sensor 9 is used as the voltage VS corresponding to the reference pressure. Meanwhile, if the elapsed time TS is greater than or equal to the prescribed time period TD in Step S106, then control proceeds to Step S109 and the latest voltage VA detected by the absolute pressure sensor 9 is used as the voltage VS corresponding to the reference pressure. When the elapsed time TS is longer than the prescribed time period TD, there is the risk that variations in the atmospheric pressure will cause a misdiagnosis. Thus, control proceeds to Step S110, where elapsed time TS is held at 0, and this control cycle ends.

When the fuel vapor treatment system 20 is in the purge cut state and the elapsed time of the reference pressure does not satisfy the condition, then misdiagnosis caused by a change in the atmospheric pressure can be prevented by overwriting the reference pressure VS with the detected pressure VA (Step S109).

If the purge valve 8 is open (i.e., in purge state where fuel vapor is being removed from the canister 3 to the intake passage 6) in Step S102, then control proceeds to Step S111 where it is determined if elapsed time TS is shorter than the prescribed time period TD (e.g., 150 seconds). If elapsed time TS is greater than or equal to the prescribed time period TD, then control proceeds to Step S113 where the failure diagnosis is cancelled and the voltage VS corresponding to the reference pressure is held because there is the risk that a misdiagnosis will occur due to a change in the atmospheric pressure. Next, the elapsed time TS is incremented in Step S114 and control ends. When the fuel vapor treatment system 20 is in the purge state and the elapsed time TS of the reference pressure does not satisfy the condition, i.e., too much time has elapsed, the failure diagnosis is cancelled and further control is limited to incrementing the time because there is the possibility of misdiagnosis caused by a change in the atmospheric pressure.

If elapsed time TS is shorter than prescribed time period TD, then the controller 15 proceeds to conduct the failure diagnosis. In Step S112, the controller 15 holds voltage VS of the absolute pressure sensor 9 and increments the elapsed time TS (Step S115), which is the time elapsed since the reference value was set.

In Step S116, the controller 15 calculates the difference between voltage VS corresponding to the reference pressure and voltage VA detected by the absolute pressure sensor 9 and compares this voltage difference with a prescribed voltage VT. It is also acceptable to covert the difference between the voltage VS corresponding to the reference pressure and voltage VA detected by the absolute pressure sensor 9 into a pressure and compare the resulting pressure PQ with a prescribed pressure PT. If pressure PQ is smaller than the prescribed pressure PT (e.g., −70 mmHg), the controller 15 assumes the drain cut valve 11 is opening normally and the control cycle ends. If pressure PQ is greater than or equal to the prescribed pressure PT, then control proceeds to Step S117 where it is determined that the drain cut valve 11 is stuck in the closed state. The purge valve 8 closes and an error warning is issued to the driver.

Figure 3:
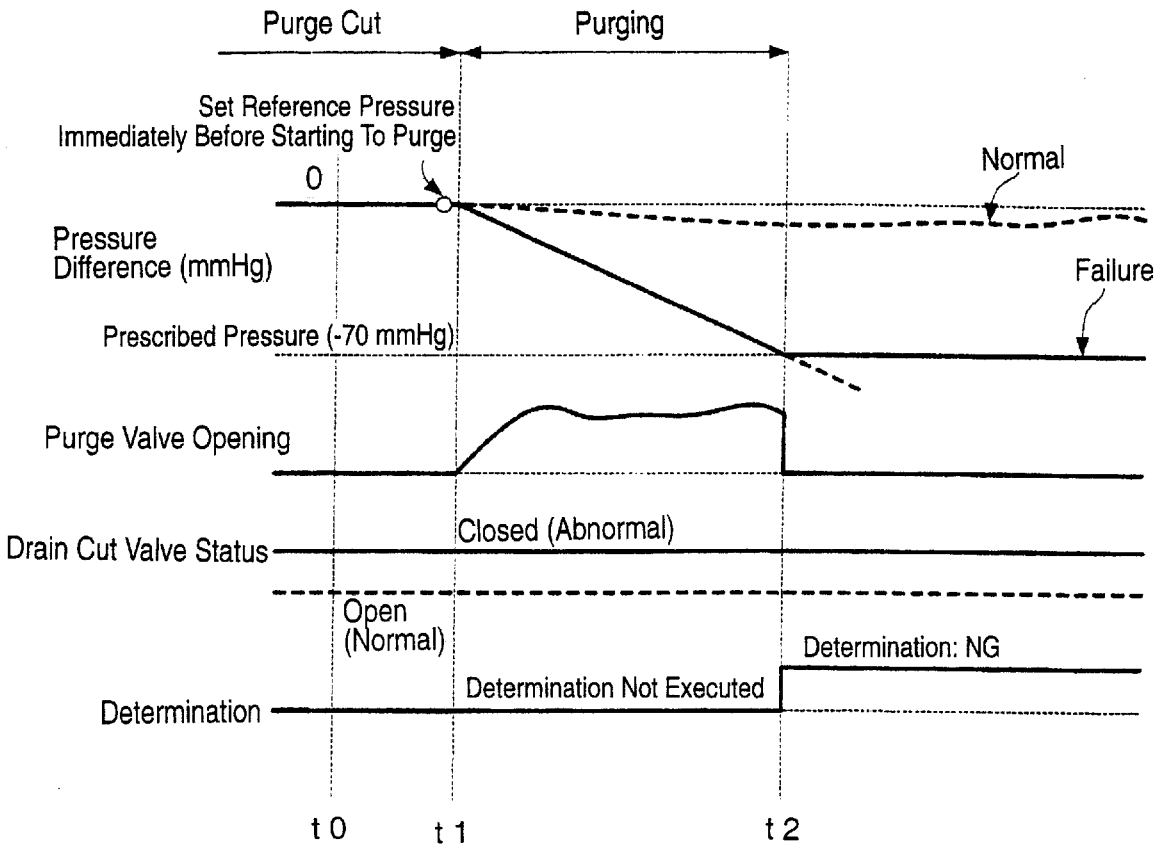
FIG. 3 timing chart indicating an operating state for each component of the fuel vapor treatment system illustrated FIG. 1 in accordance with the present invention.

The timing chart shown in FIG. 3 shows the operating state of each component as a time series. In the initial state represented as time t0, fuel vapor is not introduced into the intake passage 6 from the canister 3 (purge cut state). In the initial state, the purge valve 8 is also closed and the pressure difference between the reference pressure and the detected pressure is approximately 0. Actually, there is a pressure difference of roughly−10 mmHg even when the drain cut valve 11 is normal (fully open), as shown in the figure. In the initial state, the drain cut valve 11 is normally open (indicated by dotted line) if it is operating properly but, for the purpose of explanation, it is assumed that the drain cut valve 11 is behaving abnormally, i.e., stuck in the closed state (indicated by solid line).

At time t1, the purge valve 8 opens (Step S102) and fuel vapor from the canister 3 is directed into the intake passage 6. As purging begins, the pressure inside the purge pipes 4, 7*a* and 7*b* decreases and the pressure difference gradually increases. If the pressure difference reaches the prescribed pressure PT (e.g., −70 mmHg) at or before time t2 (Step S116), it is determined that the drain cut valve 11 is stuck in the closed state, and thus, the drain cut valve 11 is abnormally operating (Step S117). When an abnormality in the drain cut valve 11 is determined to exist, the purge valve 8 is closed and purging is ended.

Since the reference pressure is detected immediately before time t1, i.e., immediately before purging commences, the reference pressure (i.e., the atmospheric pressure) can be set reliably and precisely.

If the purge valve 8 is not closed at time t2, the pressure difference will become even larger, as indicated by the broken line, and reach roughly −500 mmHg. Therefore, failure diagnosis of the drain cut valve 11 can be conducted by providing the fuel vapor treatment system 20 with only one the absolute pressure sensor 9 and not using an atmospheric pressure sensor. Thus, eliminating a separate atmospheric pressure sensor can reduce the cost of the fuel vapor treatment system 20.

Also, by setting a prescribed time period TD for the prescribed pressure to be reached after setting the reference pressure, the fuel vapor treatment system 20 can suppress changes in the pressure difference caused by the reference pressure (atmospheric pressure fluctuates) changing due to movement of the vehicle, and thus prevent misdiagnosis.

Next is a description of the leak diagnosis of the path between the fuel tank 2 and the purge valve 8 executed after the drain cut valve 11 has been diagnosed as operating in an abnormal manner.

Figure 4:
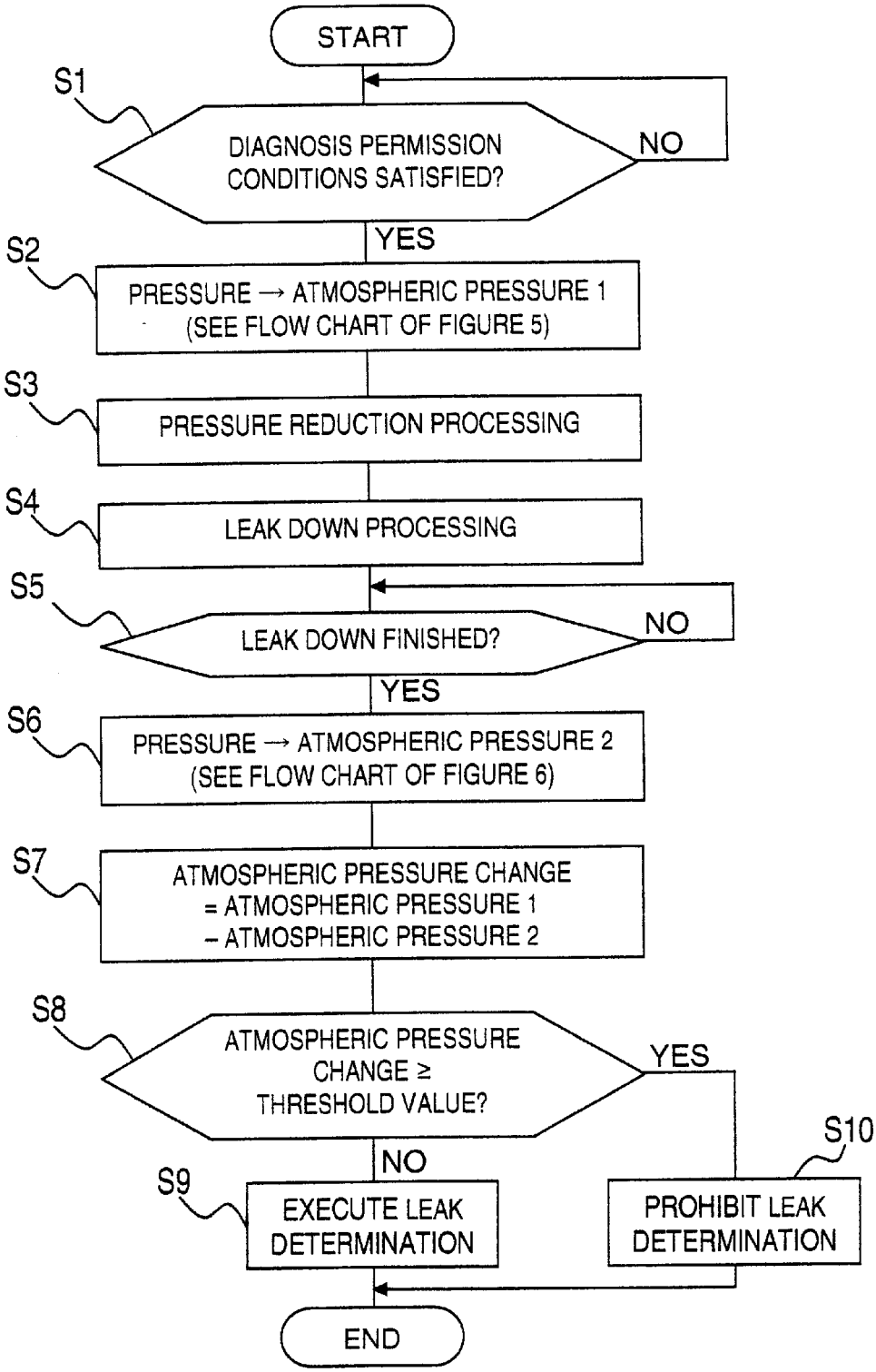
FIG. 4 is a control flowchart for performing a leak diagnosis in the fuel vapor treatment system illustrated FIG. 1 in accordance with the present invention.

The control details of a leak diagnosis performed on the fuel vapor treatment system 20 by the controller 15 will be explained based on the flowcharts shown in FIGS. 4 to 6.

In Step S1 (FIG. 4), the controller 15 checks if the permission conditions for leak diagnosis are satisfied. The permission conditions are satisfied when the vehicle is operating in a prescribed region where the purge valve 8 is closed; the coolant temperature, intake air temperature, fuel temperature, atmospheric pressure, etc., are in a prescribed range; and no other diagnosis has discovered as operating in an abnormal manner.

If the leak diagnosis permission conditions are satisfied, then control proceeds to Step S2 where pre-diagnosis atmospheric pressure measurement processing is executed. This processing involves measuring a pre-leak diagnosis atmospheric pressure 1, which is the atmospheric pressure before the leak diagnosis.

Figure 5:
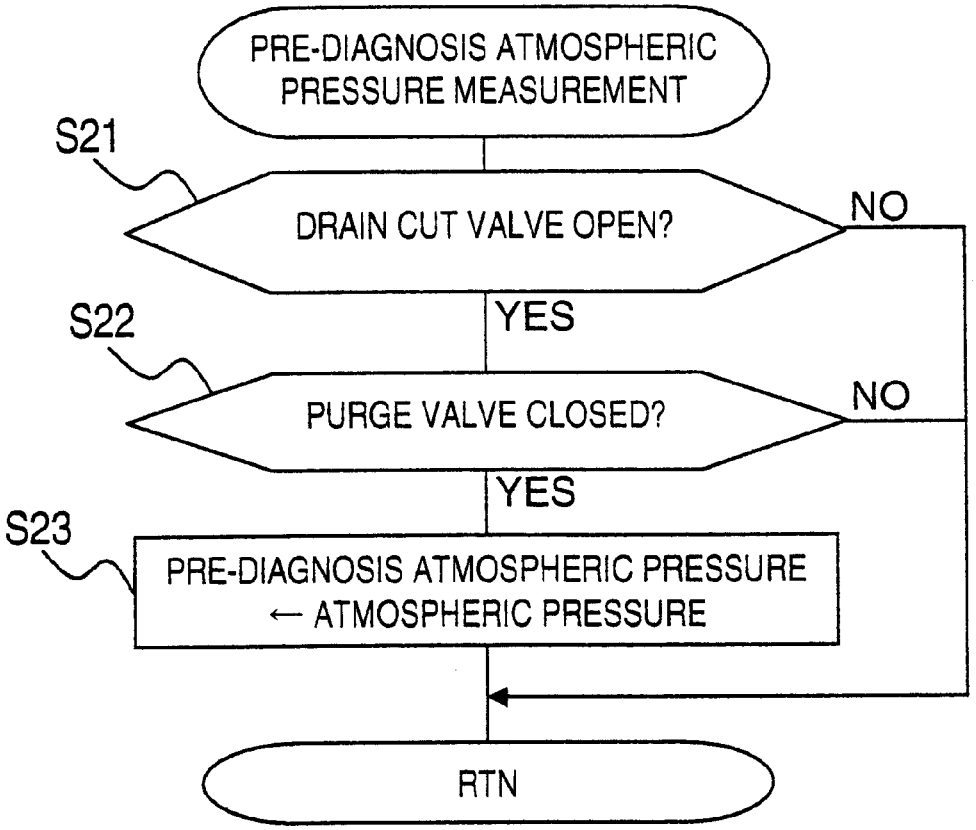
FIG. 5 is an additional control flowchart used in performing the leak diagnosis in the control flowchart of FIG. 4 in accordance with the present invention.

As shown in FIG. 5, the pre-diagnosis atmospheric pressure measurement processing involves checking if the drain cut valve 11 is open in Step S21 and checking if the purge valve 8 is closed in Step S22.

If the drain cut valve 11 is open and the purge valve 8 is closed, the controller 15 proceeds to Step S23 and reads in the current output value of the absolute pressure sensor 9 as the atmospheric pressure.

More particularly, when purging is being executed, the drain cut valve 11 is open and the purge valve 8 is opened in accordance with the vehicle operating conditions. Consequently, the pressure inside the pipe 7*a* where the absolute pressure sensor 9 is arranged goes negative due to the negative intake pressure of the engine 1. When the purge valve 8 is subsequently closed, the negative intake pressure of the engine is blocked and the pressure inside the pipes 4, 7*a* and 7*b* becomes atmospheric pressure. It is in this state that the absolute pressure sensor 9 detects the pre-leak diagnosis atmospheric pressure 1.

Next, in Step S3, the controller 15 executes pressure reduction processing, which involves closing the drain cut valve 11, opening the purge valve 8, and reducing (pulling down) the pressure inside the fuel vapor treatment system 20 to a prescribed negative pressure using the negative intake pressure of the engine 1.

When the pressure reduction processing is finished, control proceeds to Step S4 where leak down processing (leak diagnosis) is executed. This processing involves closing the purge valve 8 so as to block off the fuel vapor treatment system 20 and detecting the pressure change inside the fuel vapor treatment system 20 using the absolute pressure sensor 9.

In this leak diagnosis, the controller 15 measures how much the pressure inside the fuel vapor treatment system 20 increases in a predetermined amount of time.

When the leak diagnosis is finished, control proceeds from Step S5 to Step S6, where post-diagnosis atmospheric pressure measurement processing is executed. This processing involves opening the drain cut valve 11 and measuring a post-diagnosis atmospheric pressure 2, which is the atmospheric pressure after the leak diagnosis.

Figure 6:
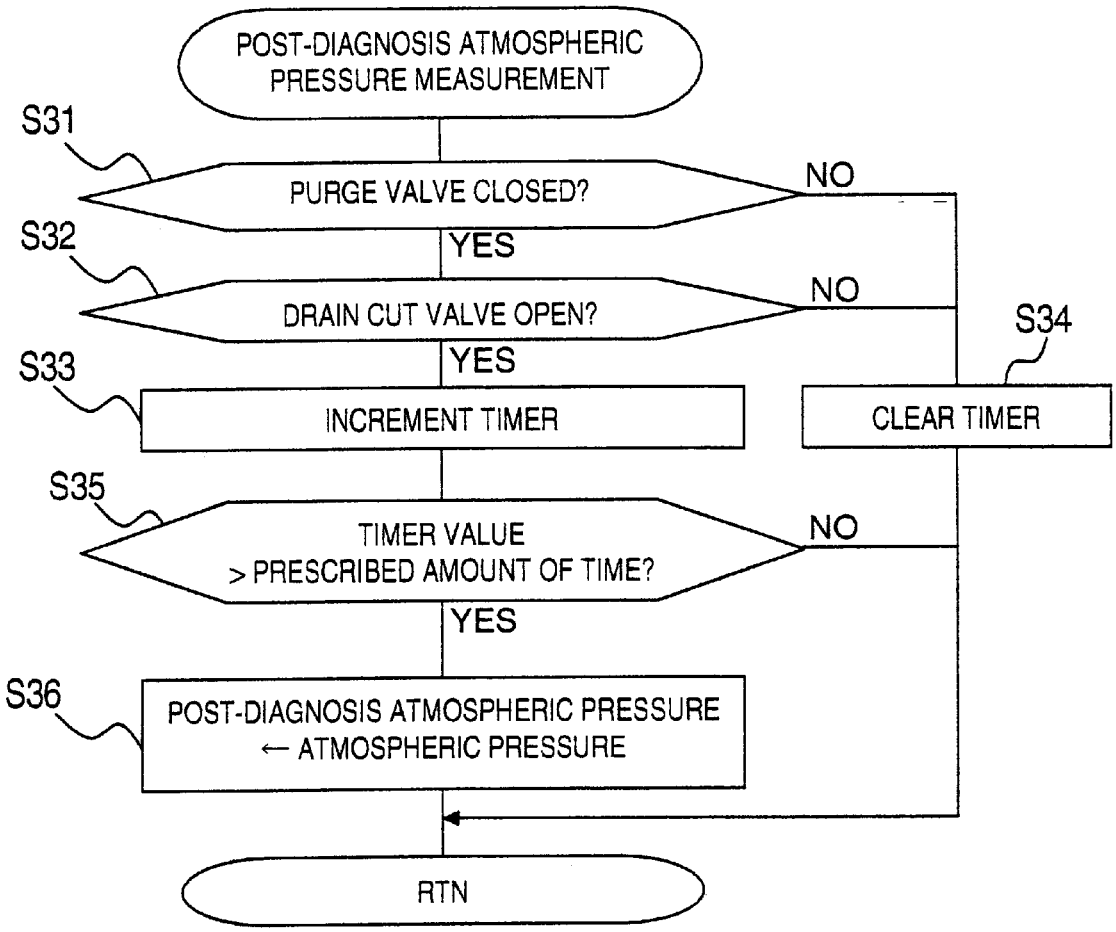
FIG. 6 is an additional control flowchart used in performing the leak diagnosis in the control flowchart of FIG. 4 in accordance with the present invention

As shown in FIG. 6, the post-diagnosis atmospheric pressure measurement processing involves checking if the purge valve 8 is closed in Step S31 and checking if the drain cut valve 11 is open in Step S32.

If the purge valve 8 is not closed or the drain cut valve 11 is not open, the timer that measures the time is cleared in Step S34.

If the purge valve 8 is closed and the drain cut valve 11 is open, the timer increments in Step S33 to count the amount of time this state has continued. Then, control proceeds to Step S35.

In Step S35, if the time counted by the timer has reached a prescribed amount of time, i.e., if a prescribed amount of time has elapsed while the purge valve 8 has remained closed and the drain cut valve 11 has remained open, the controller 15 proceeds to Step S36 and reads in the current output valve of the absolute pressure sensor 9 as the atmospheric pressure.

Thus, after the leak diagnosis, atmospheric air is introduced into the pipe 7*a* (where the absolute pressure sensor 9 is arranged) by opening the drain cut valve 11. When the purge valve 8 has been closed and the drain cut valve 11 has been open for a prescribed amount of time, the inside of the pipe 7 reaches atmospheric pressure and the absolute pressure sensor 9 detects the post-leak diagnosis atmospheric pressure 2.

Next, control proceeds to Step S7 where the change in the atmospheric pressure is calculated based on the difference between the pre-leak diagnosis atmospheric pressure 1 and the post-leak diagnosis atmospheric pressure 2.

In Step S8, the change in the atmospheric pressure is compared to a threshold value. If the change in atmospheric pressure is less than the threshold value, a leak determination is conducted in Step S9.

The leak determination involves comparing the data (increase in pressure inside the fuel vapor treatment system 20 during a predetermined amount of time) obtained in Step S4 with a prescribed value and determining the fuel vapor treatment system 20 to be normal if the datum is less than or equal to the prescribed value and abnormal if the datum is greater than the prescribed value.

Meanwhile, if the change in atmospheric pressure exceeds the threshold value, control proceeds to Step S10 where the leak determination is prohibited, i.e., the data measured in Step S4 is canceled.

Figure 7:
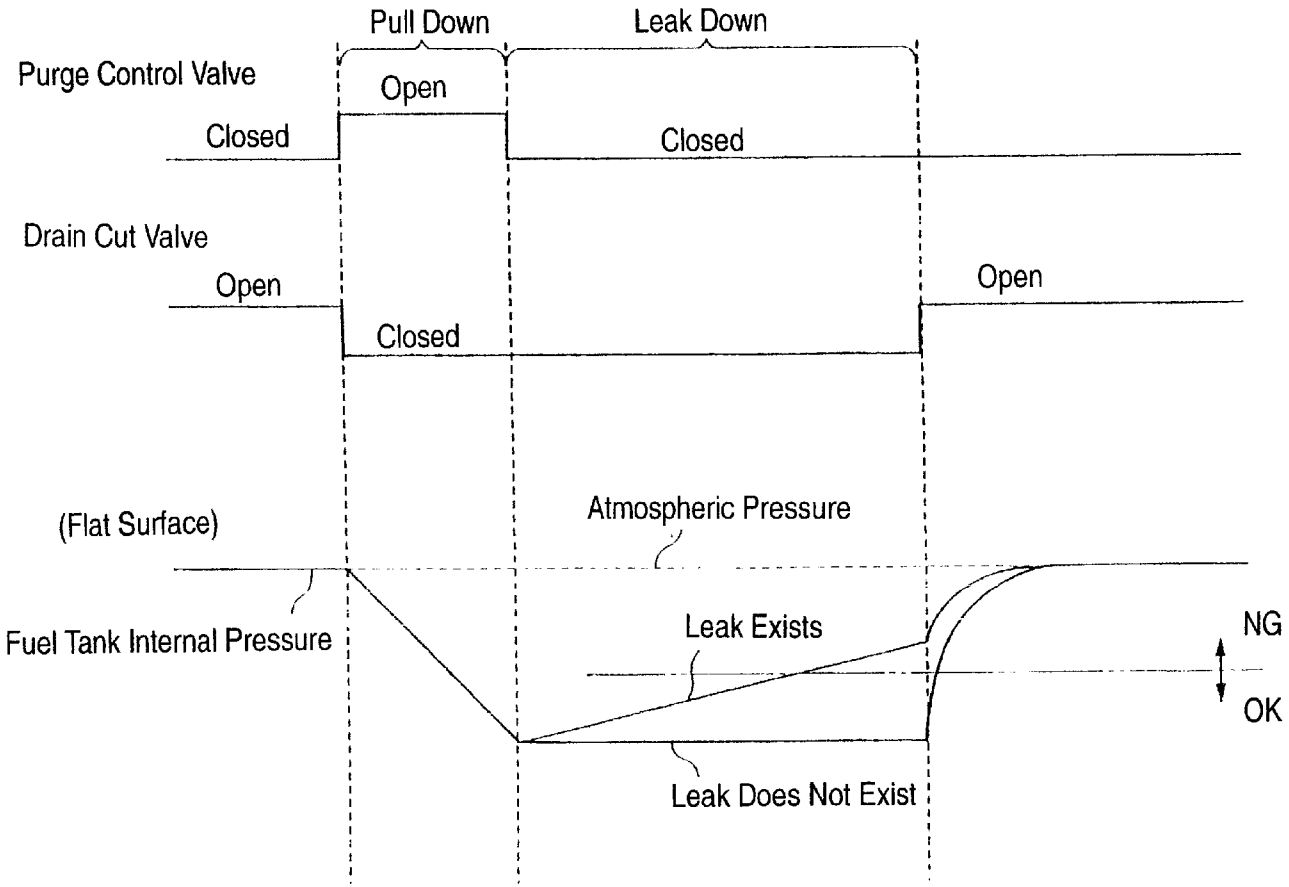
FIG. 7 is a first leak diagnosis control timing chart for the leak diagnosis performed by FIG. 4 on the fuel vapor treatment system illustrated FIG. 1 in accordance with the present invention.
Figure 8:
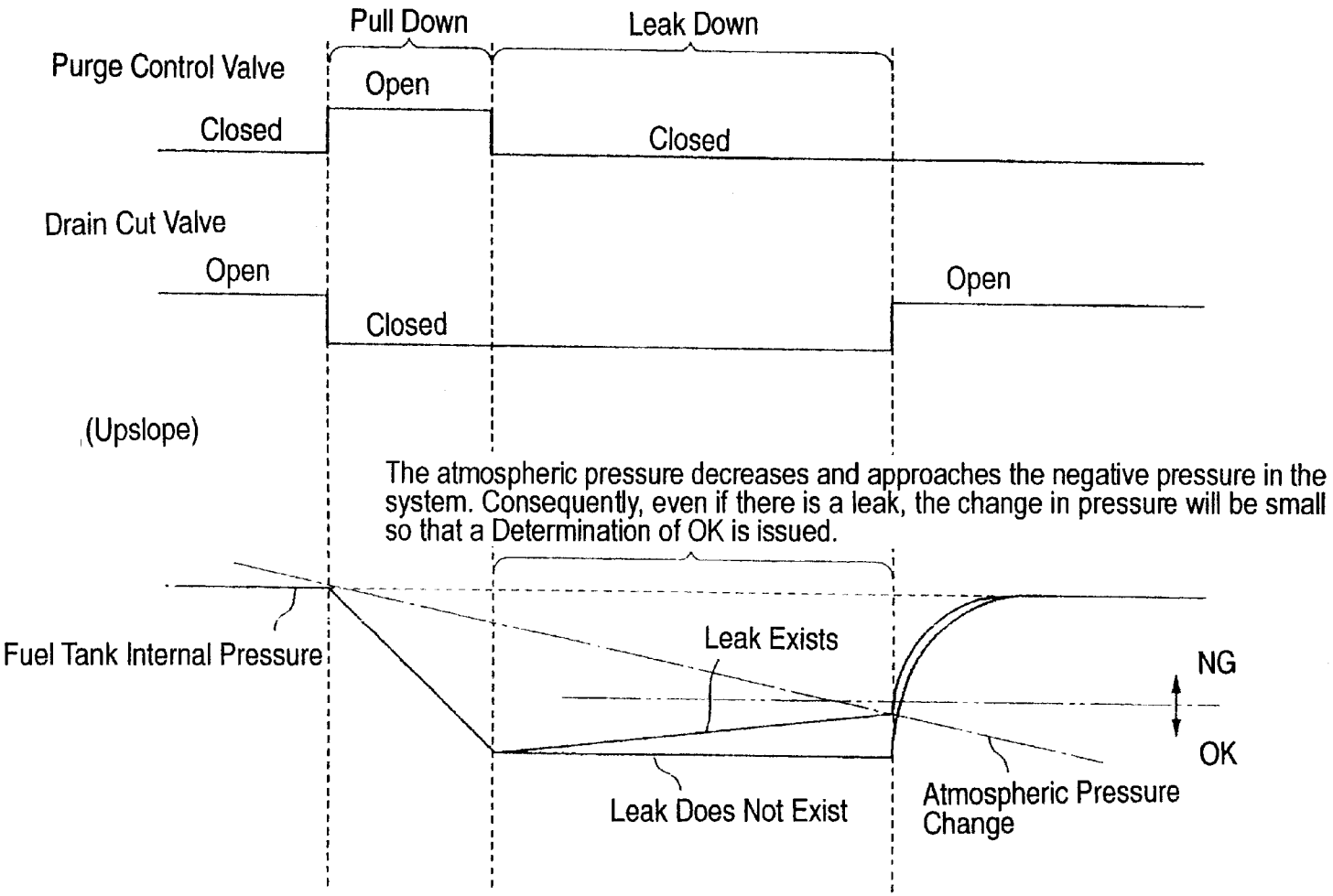
FIG. 8 is a second leak diagnosis control timing chart for the leak diagnosis performed by FIG. 4 on the fuel vapor treatment system illustrated FIG. 1 in accordance with the present invention.

FIGS. 7 and 8 show timing charts for the leak diagnosis control. FIG. 7 illustrates a case where the atmospheric pressure does not change. If there is not a leak, the pressure inside the fuel vapor treatment system 20 (inside the fuel tank 2) will not change during the leak diagnosis. On the other hand, the diagnosis will indicate an abnormality (leak)

if the increase in pressure inside the fuel vapor treatment system 20 within a predetermined amount of time exceeds a prescribed value. FIG. 8 illustrates a case where the atmospheric pressure changes during the leak diagnosis. If the change in atmospheric pressure exceeds a prescribed value, the leak determination is prohibited.

Thus, by arranging one the absolute pressure sensor 9 in the fuel vapor treatment system 20, both the pressure inside the fuel vapor treatment system 20 and the atmospheric pressure can be detected without installing a plurality of pressure sensors and the cost can be lowered.

The atmospheric pressure can be detected with good precision because the atmospheric pressure is detected when the drain cut valve 11 is open and the purge valve 8 is closed. Furthermore, since both the pressure inside the fuel vapor treatment system 20 and the atmospheric pressure can be detected with a single the absolute pressure sensor 9, the structure of the diagnostic system does not become complex and the cost can be reduced even further.

Meanwhile, during the leak diagnosis control, the atmospheric pressure is detected by the absolute pressure sensor 9 before and after the leak diagnosis and if the change in atmospheric pressure exceeds a prescribed value, the leak determination is prohibited. As a result, the change in atmospheric pressure can be detected with certainty and an incorrect leak diagnosis can be prevented.

For example, if the vehicle experiences a decrease in atmospheric pressure caused by climbing a hill after the leak diagnosis has started, the difference between the pressure inside the fuel vapor treatment system 20 and the atmospheric pressure will decrease, as shown in FIG. 8. If the atmospheric pressure changes beyond a prescribed value, the leak determination is prohibited so that misdiagnosis can be prevented.

When the leak diagnosis is finished, there is still negative pressure inside the fuel vapor treatment system 20 immediately after the drain cut valve 11 is opened while the purge valve 8 remains closed. However, the change in atmospheric pressure can be detected more reliably because the post-leak diagnosis atmospheric pressure is detected when a prescribed amount of time has elapsed after opening the drain cut valve 11.

The present invention can also be arranged such that, before commencing the leak diagnosis, a prescribed amount of time is waited after closing the purge valve 8 until the pre-leak diagnosis atmospheric pressure is detected.

Figure 9:
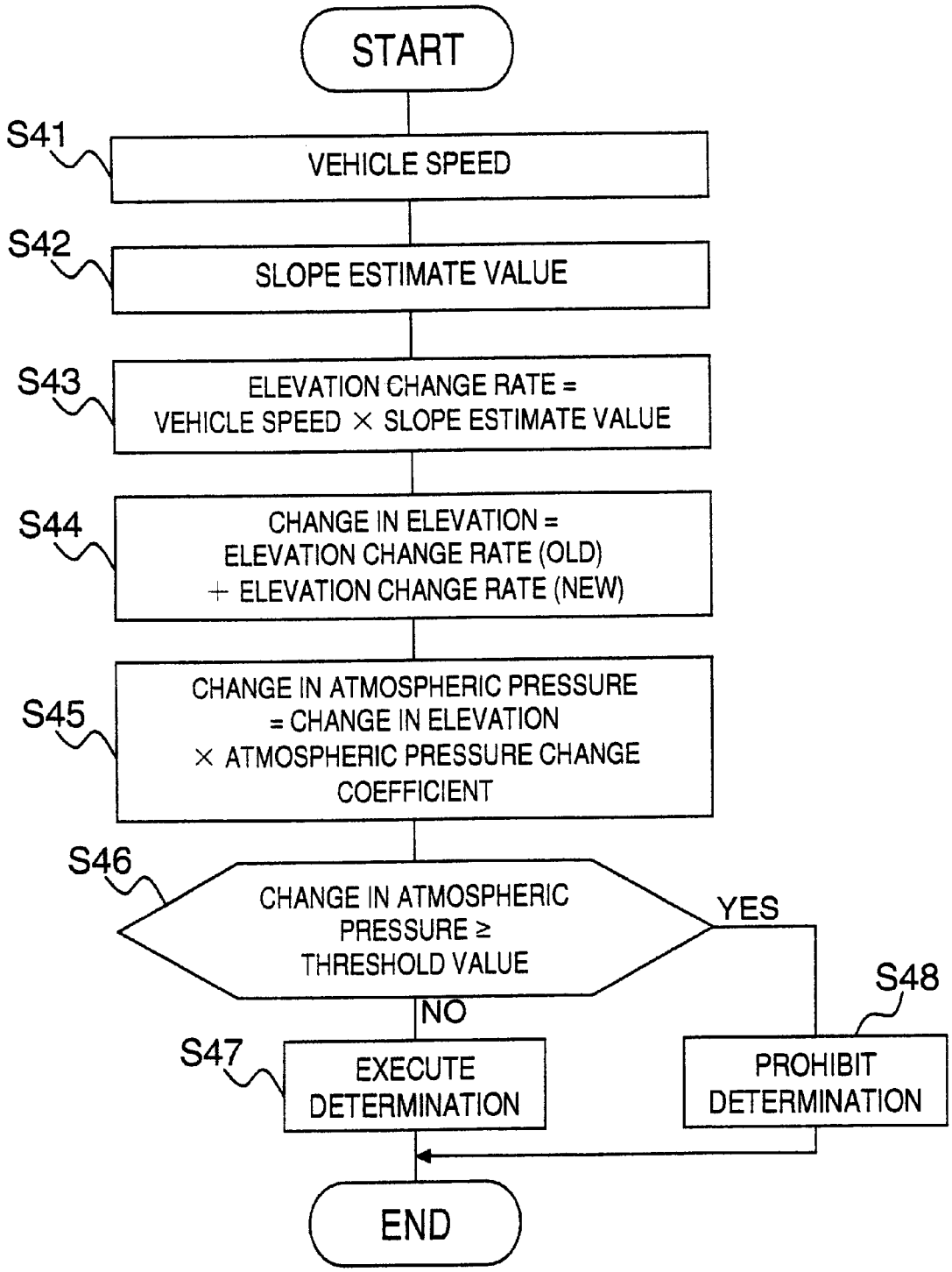
FIG. 9 is a control flowchart for performing a leak diagnosis in the fuel vapor treatment system illustrated FIG. 1 in accordance with another embodiment of the present invention.

Referring now to FIG. 9, control details of a modified leak diagnosis performed on the fuel vapor treatment system 20 by the controller 15 will be explained based on the flowchart shown in FIG. 9. Here, instead of detecting the atmospheric pressure with the absolute pressure sensor 9, the change in atmospheric pressure is estimated based on the vehicle speed and slope of the road.

Control starts when the leak diagnostic permission conditions have been satisfied.

In Step S41, the controller 15 reads in the vehicle speed.

In Step S42, the controller 15 estimates the slope of the road. Here, the controller 15 compares the current engine speed and engine load (throttle position, etc.) with previously stored engine speed and engine load (throttle position, etc.) data corresponding to travel on a level surface and estimates the slope based on the relative size or the difference between the respective data.

In Step S43, the controller 15 calculates the change in elevation per unit time, i.e., elevation change rate, by multiplying the vehicle speed by the slope estimate value. The slope estimate value and elevation change rate are positive when the vehicle is climbing and negative when the vehicle is descending.

In Step S44, the elevation change rate is cumulated each computational timing cycle to obtain the change in elevation.

In Step S45, the elevation change is multiplied by an atmospheric pressure change coefficient to obtain the change in atmospheric pressure. An acceptable atmospheric pressure change coefficient is, for example, 9 mmHg per 100 m.

From Step S46 on, the leak determination part of the leak diagnosis is conducted or prohibited based on the change in atmospheric pressure.

With this arrangement, there is no need to wait for the results obtained from monitoring the change in atmospheric pressure before and after the leak diagnosis. Rather, the leak diagnosis can be cancelled in real time.

Figure 10:
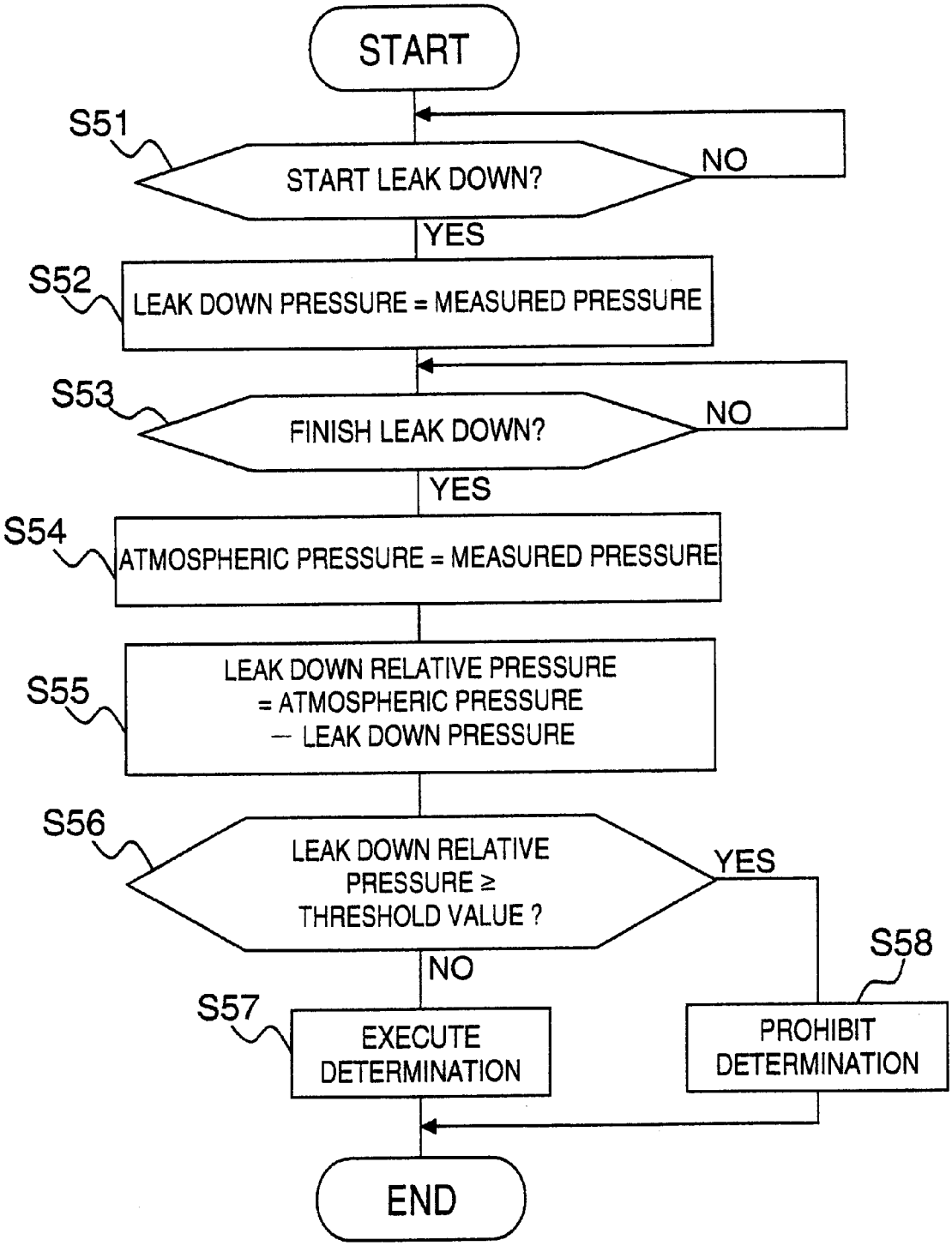
FIG. 10 is a control flowchart for performing a leak diagnosis in the fuel vapor treatment system illustrated FIG. 1 in accordance with another embodiment of the present invention.
Figure 11:
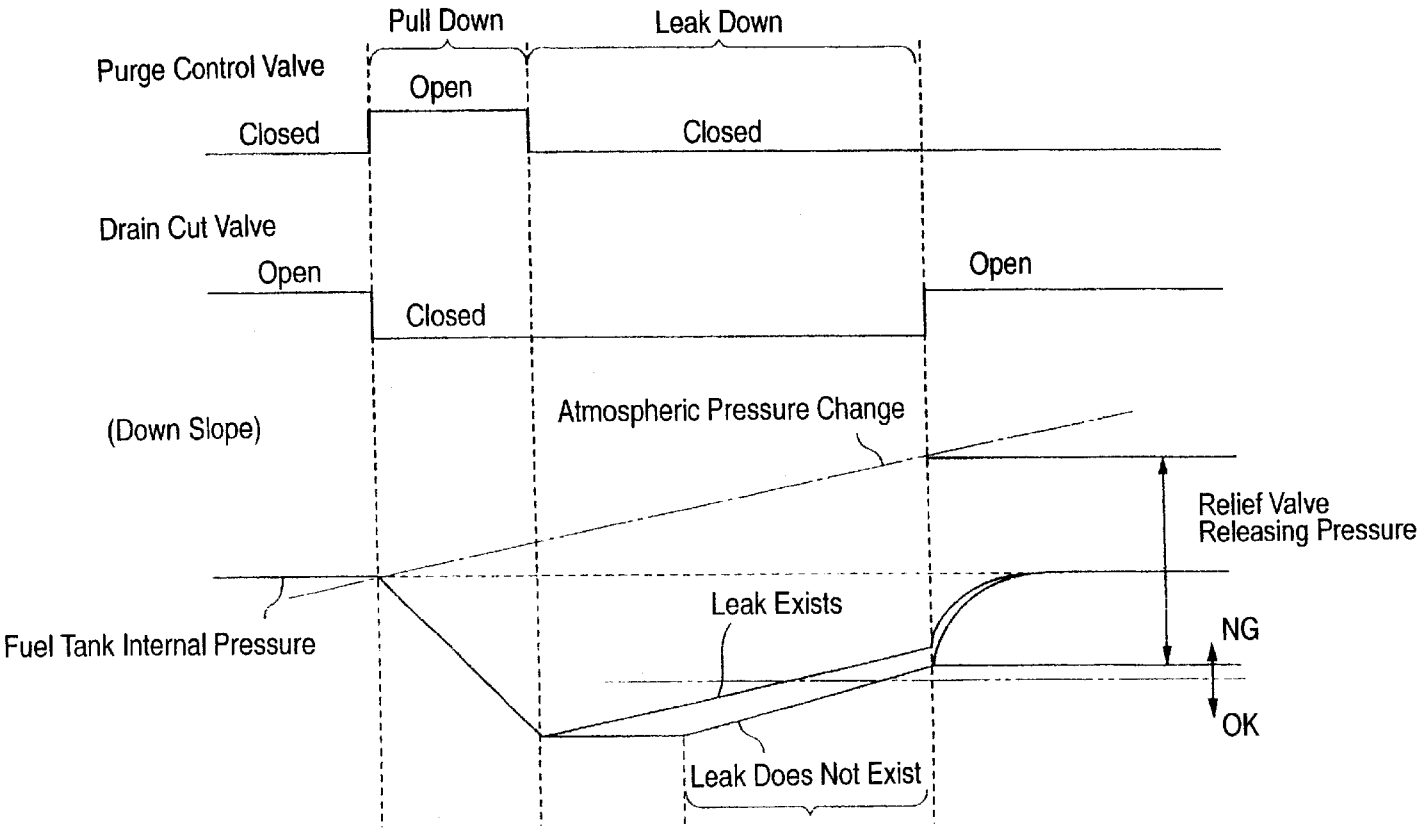
FIG. 11 is a leak diagnosis control timing chart for the leak diagnosis performed by FIG. 10 on the fuel vapor treatment system illustrated FIG. 1 in accordance with the present invention.

Referring now to FIGS. 10 and 11, control details of a modified leak diagnosis performed on the fuel vapor treatment system 20 by the controller 15 will be explained based on the flowchart shown in FIG. 10 and the timing chart shown in FIG. 11. During the leak diagnosis, this embodiment prohibits the leak determination when the difference between the atmospheric pressure and the pressure inside the fuel vapor treatment system 20 is greater than or equal to the opening pressure of the relief valve (not shown) provided in the filler cap 12 of the fuel tank 2.

In Step S51, the controller 15 determines whether or not to start leak down processing (leak diagnosis).

If leak down processing is started, in Step S52 the controller 15 takes the minimum value of the pressure inside the fuel vapor treatment system 20 detected by the absolute pressure sensor 9 during the leak down processing and stores it as the leak down pressure.

When the leak down processing is finished, control proceeds from Step S53 to Step S54 where the controller 15 opens the drain cut valve 11 and the stores the post-leak diagnosis atmospheric pressure detected by the absolute pressure sensor 9.

In Step S55, the controller 15 calculates the difference (leak down relative pressure) between the post-leak diagnosis atmospheric pressure and the leak down pressure.

In Step S56, the controller 15 compares the leak down relative pressure with the opening pressure (threshold value) of the relief valve provided in the filler cap 12 of the fuel tank 2. If the leak down relative pressure is smaller than the opening pressure, the controller 15 executes the leak determination (Step S57).

Meanwhile, if the leak down pressure is greater than or equal to the opening pressure, the controller 15 prohibits the leak determination (Step S58).

As seen in FIG. 11, a timing chart is shown for the leak diagnosis control just described in FIG. 10.

After the leak diagnosis is started, assume, for example, that the atmospheric pressure rises due to the vehicle descending a hill. When the relative pressure, i.e., difference between the atmospheric pressure and the pressure inside the fuel vapor treatment system 20, becomes large, even if there is no leak the relief valve of the filler cap 12 will open and atmospheric air will flow into the fuel vapor treatment system 20, possibly increasing the pressure inside the fuel vapor treatment system 20. However, since the leak determination is prohibited when the difference between the atmospheric pressure and the pressure inside the fuel vapor treatment system 20 is greater than or equal to the opening pressure of the relief valve of the filler cap 12, misdiagnosis caused by the operation of the relief valve of the filler cap 12 can be prevented.

Figure 12:
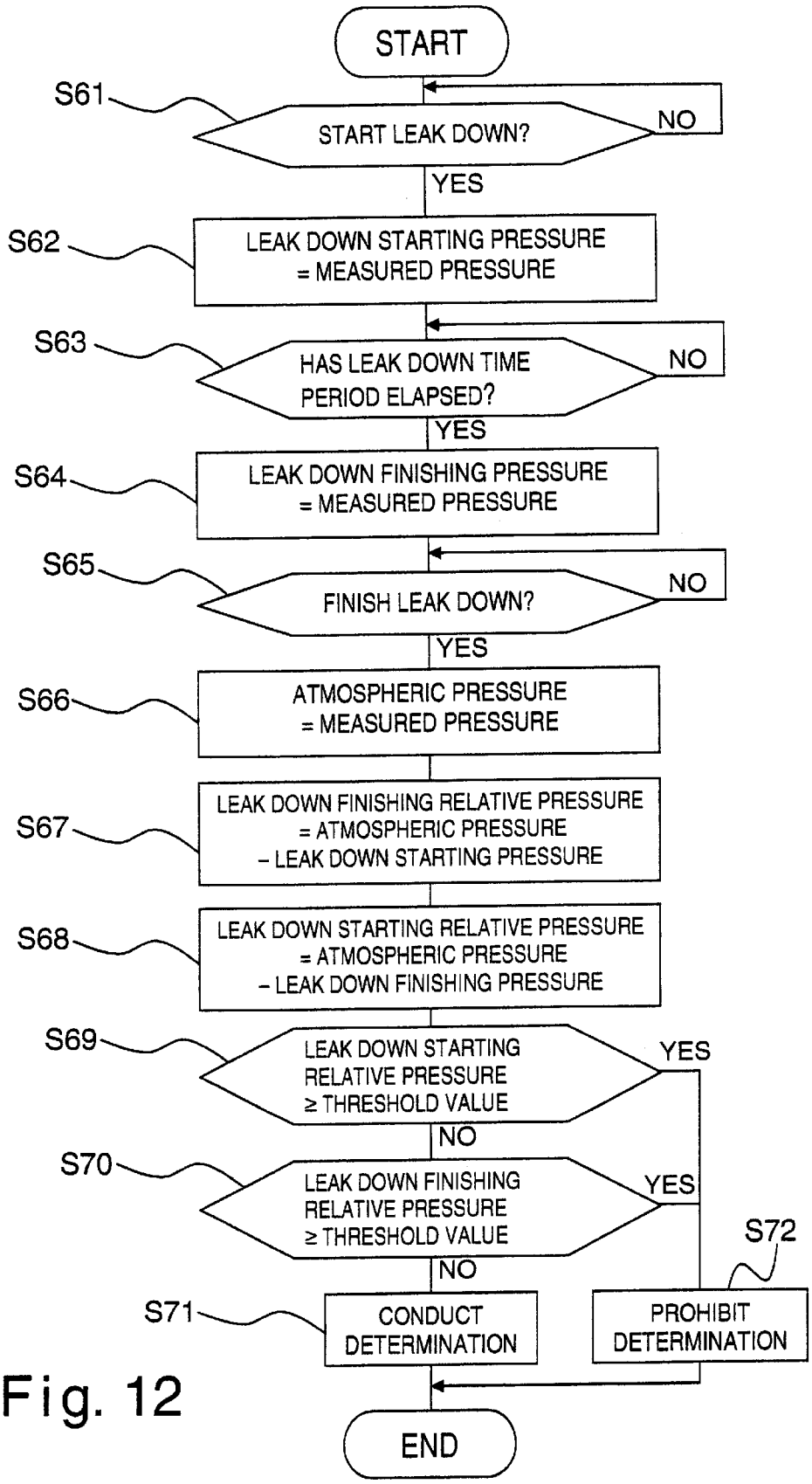
FIG. 12 is a control flowchart for performing a leak diagnosis in the fuel vapor treatment system illustrated FIG. 1 in accordance with another embodiment of the present invention.

Referring now to FIG. 12, control details of a modified leak diagnosis performed on the fuel vapor treatment system 20 by the controller 15 will be explained based on the flowchart shown in FIG. 12. This embodiment measures the pressure inside the fuel vapor treatment system 20 when the leak diagnosis starts and when the leak diagnosis ends. The leak determination is prohibited when the difference between these pressures and the atmospheric pressure is greater than or equal to the opening pressure of the relief valve in the filler cap 12 of the fuel tank 2.

In Step S61, the controller 15 determines whether or not to start leak down processing (leak diagnosis).

If leak down processing is started, in Step S62, the controller 15 stores the pressure inside the fuel vapor treatment system 20 detected by the absolute pressure sensor 9 as the leak down starting pressure.

In Step S63, the controller 15 measures the leak down time.

When the leak down time period has elapsed, in Step S64 the controller 15 stores the pressure inside the fuel vapor treatment system 20 detected by the absolute pressure sensor 9 as the leak down finishing pressure.

When the leak down processing is finished, control proceeds from Step S65 to Step S66 where the controller 15 opens the drain cut valve 11 and the stores the post-leak diagnosis atmospheric pressure detected by the absolute pressure sensor 9.

In Step S67, the controller 15 calculates the difference (leak down starting relative pressure) between the post-leak diagnosis atmospheric pressure and the leak down starting pressure and in Step S68 it calculates the difference (leak down finishing relative pressure) between the post-leak diagnosis atmospheric pressure and the leak down finishing pressure.

In Steps S69 and S70, the controller 15 compares the leak down starting relative pressure and the leak down finishing relative pressure with the opening pressure (threshold value) of the relief valve provided in the filler cap 12 of the fuel tank 2. If both are smaller than the opening pressure, the controller 15 executes the leak determination (Step S71).

Meanwhile, if either of the leak down starting relative pressure and the leak down finishing relative pressure is greater than or equal to the opening pressure, the controller 15 prohibits the leak determination (Step S72).

With this embodiment, the pressure measurement is easier to conduct than in the fourth embodiment, where the minimum value of the pressure inside the fuel vapor treatment system 20 was detected. Furthermore, it is also acceptable to detect only the leak down starting pressure.

The term "configured" as used herein to describe a component, section or part of a device includes hardware and/or software that is constructed and/or programmed to carry out the desired function.

Moreover, terms that are expressed as "means-plus function" in the claims should include any structure that can be utilized to carry out the function of that part of the present invention.

The terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

This application claims priority to Japanese Patent Application No. 2001-228957. The entire disclosure of Japanese Patent Application No. 2001-228957 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A fuel vapor treatment system comprising:

a fuel tank;

a canister fluidly coupled to the fuel tank by a first pipe and configured to adsorb fuel vapor evaporated from the fuel tank;

a drain cut valve operatively coupled to the canister to control air flow into the canister;

a purge valve disposed in a second pipe fluidly coupled between the canister and an intake passage of an internal combustion engine into which fuel vapor flows from the canister;

a sensor configured and arranged to detect absolute pressure inside at least one of the first and second pipes; and a failure diagnosis device configured and arranged to set a reference pressure used for failure diagnosis of the drain cut valve while the purge valve is closed, the failure diagnosis device being further configured to calculate a pressure difference between the reference pressure and an absolute pressure inside at least one of the first and second pipes detected by the sensor after purging commences and to determine if the drain cut valve has failed based on the pressure difference.

2. The fuel vapor treatment system as recited in claim 1, wherein the failure diagnosis device is further configured to set the reference pressure based on an absolute pressure inside at least one of the first and second pipes detected by the sensor immediately before purging to the intake passage commences.

3. The fuel vapor treatment system as recited in claim 1, wherein the failure diagnosis device calculates the pressure difference within a first prescribed period of time after the reference pressure is set.

4. The fuel vapor treatment system as recited in claim 3, wherein the failure diagnosis device successively overwrites the reference pressure when purging to the intake passage is stopped and the drain cut valve has been open for at least a second prescribed period of time.

5. The fuel vapor treatment system as recited in claim 3, wherein the failure diagnosis device maintains the reference pressure when purging to the intake passage is stopped and the drain cut valve has been open for less than a second prescribed period of time.

6. The fuel vapor treatment system as recited in claim 2, wherein the failure diagnosis device calculates the pressure difference within a first prescribed period of time after the reference pressure is set.

7. The fuel vapor treatment system as recited in claim 6, wherein the failure diagnosis device successively overwrites the reference pressure when purging to the intake passage is stopped and the drain cut valve has been open for at least a second prescribed period of time.

8. The fuel vapor treatment system as recited in claim 6, wherein the failure diagnosis device maintains the reference pressure when purging to the intake passage is stopped and the drain cut valve has been open for less than a second prescribed period of time.

9. A fuel vapor treatment system comprising:

storage means for containing fuel;

canister means for adsorbing fuel vapor evaporated from the storage means;

piping means for fluidly coupling the storage means to the canister means and an intake passage of an internal combustion engine;

drain cut valve means for controlling air flow into the canister;

purge valve means for regulating fuel vapor flows from the canister means to the intake passage.

sensor means for detecting absolute pressure inside the piping means; and failure diagnosis means for setting a reference pressure used for failure diagnosis of the drain cut valve while the purge valve is closed, the failure diagnosis means being further configured to calculate a pressure difference between the reference pressure and an absolute pressure inside the piping means detected by the sensor means after purging commences and determine if the drain cut valve means has failed based on the pressure difference.

10. The fuel vapor treatment system as recited in claim 9, wherein the failure diagnosis means is further configured to set the reference pressure based on an absolute pressure inside the piping means detected by the sensor means immediately before purging to the intake passage commences.

11. The fuel vapor treatment system as recited in claim 9, wherein the failure diagnosis means calculates the pressure difference within a first prescribed period of time after the reference pressure is set.

12. The fuel vapor treatment system as recited in claim 11, wherein the failure diagnosis means successively overwrites the reference pressure when purging to the intake passage is stopped and the drain cut valve means has been open for at least a second prescribed period of time.

13. The fuel vapor treatment system as recited in claim 11, wherein the failure diagnosis means maintains the reference pressure when purging to the intake passage is stopped and the drain cut valve means has been open for less than a second prescribed period of time.

14. A method for diagnosing a fuel vapor treatment system, comprising:

measuring absolute pressure inside at least one of a first pipe fluidly connecting a fuel tank to a canister configured to adsorb fuel vapor evaporated from the fuel tank and a second pipe fluidly connecting the canister and an intake passage of the internal combustion engine into which fuel vapor flows from the canister;

determining an operational state of a drain cut valve operatively coupled to the canister of the fuel vapor treatment system;

determining an operational state of a purge valve operatively coupled to the canister of the fuel vapor treatment system;

setting a reference pressure used for failure diagnosis of the drain cut valve while the purge valve is closed, controlling the internal combustion engine based on the reference pressure; and calculating a pressure difference between the reference pressure and an absolute pressure inside at least one of the first and second pipes after purging commences and determining if the drain cut valve has failed based on the pressure difference.

15. The method as recited in claim 14, wherein the reference pressure is based on an absolute pressure inside at least one of the first and second pipes immediately before purging to the intake passage commences.

16. The method as recited in claim 15, further comprising calculating the pressure difference within a first prescribed period of time after the reference pressure is set.

17. The method as recited in claim 16, wherein successively overwriting the reference pressure when purging to the intake passage is stopped and the drain cut valve has been open for at least a second prescribed period of time.

18. The method as recited in claim 16, wherein maintaining the reference pressure when purging to the intake passage is stopped and the drain cut valve has been open for less than a second prescribed period of time.

* * * * *